United States Patent [19]

Dietz

[11] Patent Number: 4,516,930

[45] Date of Patent: May 14, 1985

[54] APPARATUS AND METHOD FOR CONTROLLING A MAIN FUEL VALVE IN A STANDING PILOT BURNER SYSTEM

[75] Inventor: Gerald E. Dietz, Goshen, Ind.

[73] Assignee: Johnson Service Company, Milwaukee, Wis.

[21] Appl. No.: 431,341

[22] Filed: Sep. 30, 1982

[51] Int. Cl.[3] ..... F23Q 23/00

[52] U.S. Cl. ..... 431/26; 431/25

[58] Field of Search ..... 431/24, 25, 26

[56] References Cited

U.S. PATENT DOCUMENTS

| | | | |
|---|---|---|---|
| 2,231,420 | 2/1941 | Gille | 431/24 |
| 2,537,293 | 1/1951 | Peterson | 431/26 X |
| 2,640,920 | 6/1953 | Cairns | 431/25 X |
| 2,751,972 | 6/1956 | Loeber | 431/26 |
| 3,482,922 | 12/1969 | Blackett | 431/26 |
| 4,168,949 | 9/1979 | Hamelintz et al. | 431/80 |
| 4,382,770 | 5/1983 | Pinckaers | 431/26 |

*Primary Examiner*—Samuel Scott
*Assistant Examiner*—Carl D. Price
*Attorney, Agent, or Firm*—Larry L. Shupe; Joseph J. Jochman, Jr.; John Phillip Ryan

[57] ABSTRACT

A control apparatus for repetitively verifying the integrity of a main fuel valve control circuit in a standing pilot burner system includes a probe circuit adapted to receive an electrical signal representative of the presence of a standing pilot flame and a first circuit which coacts with the probe circuit for energizing a first relay in response to the electrical signal. A second circuit is adapted to receive a heat demand signal and coacts with the first circuit for sequentially disabling the probe circuit, de-energizing the first relay, energizing a second relay, re-enabling the probe circuit and re-energizing the first relay to actuate a main fuel valve.

9 Claims, 2 Drawing Figures

APPARATUS AND METHOD FOR CONTROLLING A MAIN FUEL VALVE IN A STANDING PILOT BURNER SYSTEM

BACKGROUND OF THE INVENTION

This invention relates to combustible fuel ignition systems and more particularly to a fuel ignition system of the standing pilot type for cyclically verifying the operating integrity of the main fuel valve circuit and for rapidly de-energizing the main fuel valve upon loss of the pilot flame.

Modern fuel ignition systems frequently employ pilot ignition circuits wherein a pilot flame is established only intermittently in response to each demand for heat and is extinguished coincidently with the shutdown of the main burner. In an effort to enhance the reliability of such systems, it has been found desirable to repetitively verify the integrity of that portion of the apparatus circuitry which controls the operation of the main fuel valve. A system for verifying the integrity of such circuitry in a pilot ignition type system is shown and described in U.S. Pat. No. 4,131,412. There, a normally open contact set R1B of a pilot relay R1 is coupled in parallel with a normally closed contact set R2A of a flame sensing relay R2. Additionally a normally open contact set R2C of the relay R2 is coupled in series with the main valve relay R3, of which normally open contacts R3C actuate the coil 19 of the main fuel valve 14. At the closure of thermostat contacts THS and upon a failure in the flame sensing circuit 20 or in relay R2, relay R3 or, in the alternative, relay R1 is prevented from being energized depending upon the position of R2 at failure. Such a system inherently provides integrity verification since the relays are forced through an operating cycle with each successive re-ignition of the pilot flame. Many devices of this type employ a thermocouple to sense the presence or absence of a pilot flame. However, the time required for a thermocouple to sufficiently cool, thus signalling the loss of the pilot flame, may be undesirably long and cooling times on the order of 90 seconds are not unusual.

While such approaches have been found satisfactory in pilot ignition type systems, they are particularly unsuited for use in systems of the standing pilot type. This is so since a standing pilot ignition system includes a constantly-burning pilot flame and no opportunity is presented for repetitively verifying the integrity of that portion of the apparatus circuitry which controls the operation of the main fuel valve. Additionally, such approaches are unsuited for rapidly de-energizing the main fuel valve upon loss of the pilot flame in a standing pilot system.

An apparatus and method adapted for use in a standing pilot system to repetitively verify the operating integrity of the device used to actuate the main fuel valve and to rapidly de-energize the main fuel valve in the event of the loss of the pilot flame would be a significant improvement over the prior art.

SUMMARY OF THE INVENTION

In general, a control apparatus for repetitively verifying the integrity of a main fuel valve control circuit in a standing pilot burner system includes a probe circuit adapted to receive an electrical signal representative of the presence of a standing pilot flame and a first circuit which coacts with the probe circuit for energizing a first relay in response to the electrical signal. A second circuit is adapted to receive a heat demand signal and coacts with the first circuit for sequentially disabling the probe circuit, de-energizing the first relay, energizing a second relay, re-enabling the probe circuit and re-energizing the first relay to actuate a main fuel valve upon the reception of the heat demand signal. Loss of the pilot flame will result in de-energization and closure of the main fuel valve within less than about one second.

A method for repetitively verifying the integrity of a main fuel valve control circuit in a standing pilot burner system includes the steps of providing a probe circuit adapted to receive an electrical signal representative of the presence of a standing pilot flame, providing a first circuit which coacts with the probe circuit for energizing a first relay in response to the electrical signal, providing a heat demand signal and sequentially disabling the electrical signal, de-energizing the first relay, energizing a second relay, re-establishing the first electrical signal and re-energizing the first relay to actuate a main fuel valve.

In a preferred embodiment, the control apparatus includes a probe circuit adapted to receive an electrical signal from a flame sensing probe, preferably of the ion-detecting type, which generates a DC signal in the presence of a pilot flame. The probe terminal is coupled to a first circuit which includes a field effect transistor for charging a first gating capacitor in response to signals emanating from the probe. When the gating capacitor is permitted to retain a charged state, a programmable unijunction transistor (PUT) gates a power rectifier to conduction. The first circuit also includes a first electromagnetic AC relay which is actuated by the power rectifier for energizing a main fuel valve and for providing a normally closed contact set which permits the initial energization of a second electromagnetic DC relay. A thermostat is provided for directing heat demand signals to a second circuit and has its electrical contacts connected in series with a normally closed contact of the second relay, the combination being connected in parallel with the probe circuit for selective disablement thereof. A normally open first contact of the second relay is connected in parallel with the aforementioned normally closed contact of the first relay to provide a holding circuit which maintains the second relay in an energized state subsequent to the energization of the first relay. Upon closure of the thermostat contacts, the probe is momentarily disabled by shorting its first electrical signal to ground through the thermostat contacts and a normally closed second contact set of the second relay and upon probe disabling, the field effect transistor will bilaterally conduct, thereby preventing the charging of the gating capacitor. In the absence of such a charge, the transistor is no longer able to gate the power rectifier to a conducting state and the first relay is de-energized. The consequent closure of a contact set of the first relay permits the energization of the second or checking relay which, when so energized, opens its contact in series with the thermostat contact, thereby permitting the probe to reestablish its electrical signal representative of the presence of the standing pilot flame. Upon the reestablishment of this electrical signal, the first circuit re-energizes the first relay to actuate a main fuel valve. In the event of a failure of the pilot flame, the first relay is de-energized to de-energize the main fuel valve.

It is an object of the present invention to provide an apparatus for controlling a main fuel valve which overcomes the aforementioned disadvantages of the prior art.

Another object of the present invention is to provide an apparatus for controlling a main fuel valve in a standing pilot burner system wherein the operating integrity of the main fuel valve control circuit is repetitively verified.

Still another object of the present invention is to provide an apparatus for controlling a main fuel valve wherein the integrity of the apparatus is repetitively verified by momentarily disabling a probe signal upon the occurrence of each heat demand signal.

Yet another object of the present invention is to provide an apparatus and method for controlling a main fuel valve in a standing pilot burner system wherein the operating integrity of the main fuel valve relay is verified by cyclically operating the relay upon the occurrence of each heat demand signal.

Still another object of the present invention is to provide an apparatus and method for controlling a main fuel valve whereby the main fuel valve is rapidly de-energized upon the loss of a standing pilot flame.

Another object of the present invention is to provide an apparatus for controlling a main fuel valve wherein the apparatus includes a second relay having electrical contacts cooperating with a thermostat contact for momentarily disabling a flame-sensing probe upon the occurrence of each heat demand signal. These and other objects of the invention will become more apparent from the detailed description thereof taken with the accompanying drawing.

DESCRIPTION OF A PREFERRED EMBODIMENT

Figure 1:
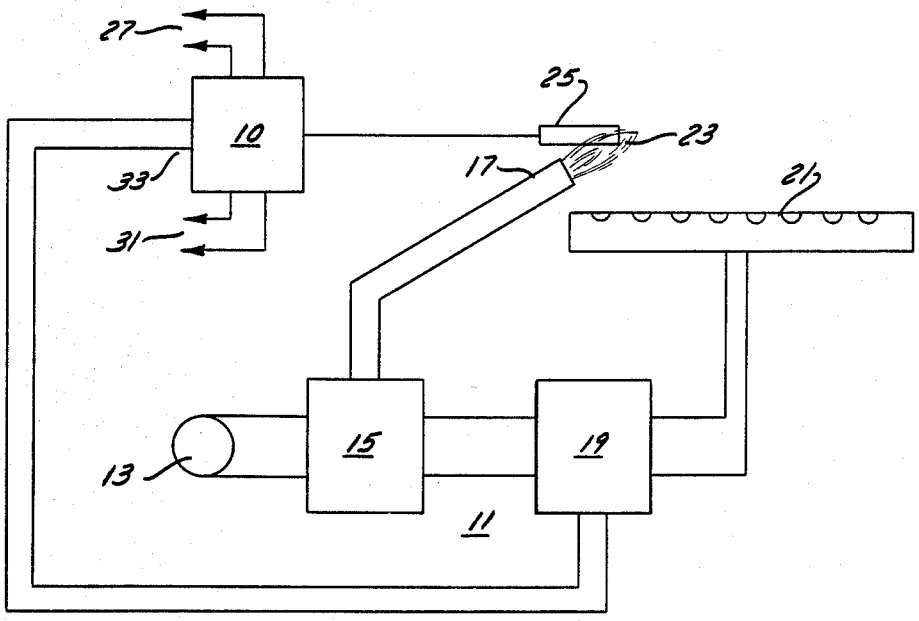
FIG. 1 is a block diagram of the control apparatus of the present invention shown in conjunction with a fuel combustion system of the standing pilot type.
Figure 2:
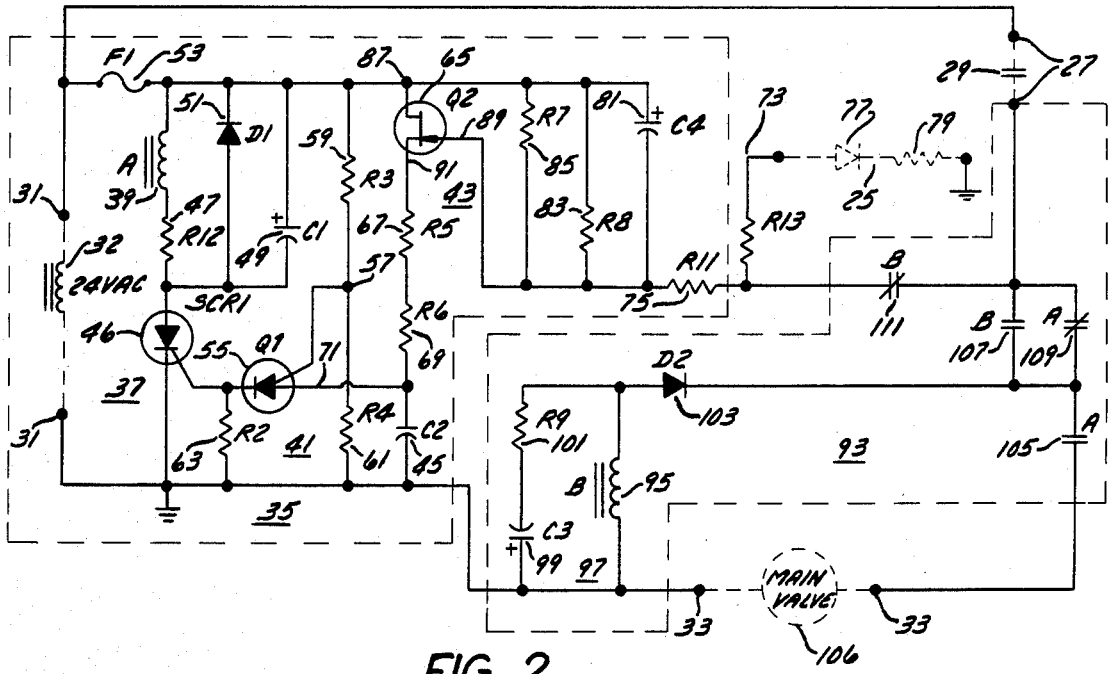
FIG. 2 is an electrical schematic diagram of the control apparatus of the present invention.

Referring to FIGS. 1 and 2, the control apparatus 10 of the present invention is shown in conjunction with a typical fuel combustion system 11 of the standing pilot type. The combustion system 11 includes an inlet 13 for receiving pressurized fuel, a manually cocked pilot fuel valve 15 for permitting fuel to flow to a manually ignited pilot jet 17 and a main fuel valve 19 for permitting fuel to flow to a main burner grate 21 for ignition by the pilot flame 23. Pilot fuel valves of the aforementioned type are known and have been in wide use for several decades. A sensing probe 25 is disposed within the pilot flame 23 and provides a signal to the apparatus 10 representative of flame presence. The apparatus 10 also includes a first pair of electrical terminals 27 for connection to thermostat contacts 29, a second pair of electrical terminals 31 for connection to a source of low voltage AC power 32 and a third pair of electrical terminals 33 for connection to the main fuel valve 19.

Referring next to FIG. 2, the control apparatus 10 of the present invention is schematically shown to include a first circuit 35 for receiving electrical signals from a flame sensing probe 25 and thereupon responsively actuating a main fuel valve 19 in accordance with a predetermined operating sequence. While such a circuit 35 may be constructed using electromagnetic relays as the controllable switching devices for fuel valve relay control, static switching devices are preferred for reasons of compactness of design, reliability and lower cost. Accordingly, the first circuit 35 includes a power rectifier network 37 for energizing the coil 39 of a first relay, a PUT gating network 41 for providing selective conduction through the power rectifier network 37 and a transistor network 43 for selectively charging a first gating capacitor 45, thereby controlling the gating network 41. The power rectifier network 37 includes the first relay coil 39 coupled in series with a power rectifier 46 which causes energization of the first relay coil 39 when switched to a conducting state. A resistor 47 is interposed between the coil 39 and the rectifier 46 for current limiting while a holding capacitor 49 provides a coil holding current during each negative one half cycle of AC power applied to the terminals 31. A protective diode 51 is coupled in parallel with the holding capacitor 49 for protection of the latter while a fuse 53 at one of the terminals 31 protects the power rectifier network 37 in the event the rectifier 46 becomes short circuited.

The unijunction transistor 55 of the gating network 41 has its gate terminal attached to a point 57 intermediate a pair of series connected resistors 59, 61 which define a voltage divider network. Current selectively flowing from the transistor 55 is directed through a voltage dropping resistor 63 for generating a voltage sufficiently high to switch the power rectifier 46 to a conducting state.

The transistor network 43 includes a field effect transistor (FET) 65 connected across the second pair of electrical terminals 31 in series with first and second dropping resistors 67, 69 respectively and the first gating capacitor 45. The anode 71 of the gating transistor 55 is attached to this series circuit intermediate the second dropping resistor 69 and the gating capacitor 45 for selectively receiving a current flow from the latter. A separately mounted flame sensing probe 25 is coupled to a probe circuit 73 adapted to receive an electrical signal from the probe 25. This signal is directed through a current limiting resistor 75 to the input side of the FET 65 for controlled gating thereof. It is preferred that the probe 25 be of the high impedance ion-detecting type which, when sensing the presence of a flame 23 and providing a resulting electrical signal, appears electrically as a diode 77 in series with a resistor 79.

A second gating capacitor 81, a first discharge resistor 83 and a second discharge resistor 85 are coupled in parallel one with the other across the drain terminal 87 and the gate terminal 89 of the FET 65. As described in greater detail below, the second gating capacitor 81 intermittently provides a signal for gating the FET 65 while the resistors 83, 85 provide a path for discharging the gating capacitor 81 during those periods when the FET 65 is in a non-gated state. It is to be understood that the FET 65 is selected to be of a type whereby when ungated, it permits the substantially free flow of electrical current in either direction therethrough. When gated, the FET 65 appears as a unidirectional electrical valve, i.e., a diode, for permitting the flow of current from its drain terminal 87 to its source terminal 91.

The apparatus 10 also includes a second circuit 93 which functions to verify the integrity of the first relay, formed of coil 39 and contacts identified below, upon the reception of each heat demand signal from thermostat contacts 29 and includes a second relay having its operating coil 95 coupled in parallel with a coil current maintaining circuit 97 comprised of a flywheel capacitor 99 in series with a current limiting resistor 101. A halfwave rectifying diode 103 is connected in series with this parallel network for controlling the direction of current flow through the second relay coil 95. Contacts associated with each of the first relay and the second relay are located as shown in FIG. 2, a first contact 105 of the first relay being located in series with the coil 106 of the main fuel valve 19 for controlled energization thereof.

A normally open first contact 107 of the second relay is coupled in parallel with a normally closed second contact 109 of the first relay for providing a second relay holding circuit. A second contact 111 of the second relay is movable between a first, normally closed position as shown and a second, normally open position and in the first position cooperates with a closed thermostat contact 29 for momentarily disabling the electrical signal of the probe 25 by shorting it to ground.

A method for repetitively verifying the integrity of a main fuel valve control circuit in a standing pilot burner system includes the steps of providing a probe circuit 73 adapted to receive an electrical signal representative of the presence of a standing pilot flame 23 and providing a first circuit 35 which coacts with the probe circuit 73 for energizing a first relay coil 39 in response to the electrical signal. Upon the provision of a heat demand signal such as, for example, by the closure of a thermostat contact 29, further steps include sequentially disabling the first electrical signal, de-energizing the first relay coil 39, energizing a second relay coil 95, re-establishing the electrical signal and re-energizing the first relay coil 39 to actuate a main fuel valve 19.

Referring to FIGS. 1 and 2 and in operation, the contacts 29 of a temperature-sensitive thermostat are coupled to the first electrical terminals 27, a source of low voltage AC power 32 is coupled to the second terminals 31 and the operating coil 106 of the main fuel valve 19 is coupled to the third pair of electrical terminals 33. Upon the application of low voltage power, 24 VAC for example, and assuming that no pilot flame has yet been ignited, the field effect transistor 65 will be maintained in a non-gated state and therefore electrically appear as a shorted connection between its drain terminal 87 and its source terminal 91. Although the first gating capacitor 45 will thereby be charged during each positive one half cycle, it will become discharged during each negative half cycle and the gating transistor 55 as well as the power rectifier 46 will be maintained in nonconducting states. The pilot fuel valve 15 is then opened and the pilot flame 23 is manually ignited. A flame sensing probe 25, preferably of the aforementioned ion-detecting type, is positioned to be disposed in a flame detecting relationship with the pilot jet 17 and upon detection thereof, provides an electrical signal which is directed through the current limiting resistor 75 to gate the FET 65 and thereby charge and develop a voltage across the second gating capacitor 81. The capacitor 81 is polarity connected such that the gate terminal 89 of the FET 65 is made negative, whereupon the FET 65 is made to appear as a diode capable of conducting current flowing from its drain terminal 87 to its source terminal 91. As current flows therethrough during a positive one half cycle, a voltage is developed across the resistors 67, 69 to charge the first gating capacitor 45. Upon the next negative one half cycle, the FET 65 will block current flow to retain the charge of the first gating capacitor 45. The voltage dividing resistors 59, 61 are selected such that the transistor 55 is prevented from being gated to a conducting state until the next successive positive one half cycle reaches its maximum value. Thereupon, electrical energy stored in the first gating capacitor 45 will flow through the transistor 55 and across the resistor 63 to gate the power rectifier 46 to a conducting state. The first relay coil 39 is thereby energized. During next successive negative one half cycles, the first relay coil 39 is maintained in an energized state by the discharge of the holding capacitor 49 through the coil 39. Upon the energization of the first relay coil 39, its first contact set 105 will be closed but because of the simultaneous opening of its second contact set 109 in parallel with the first contact set 107 of the second relay, the main fuel valve coil 106 is prevented from being energized.

A decrease in the ambient temperature sensed by the thermostat will cause a closure of the thermostat contacts 29 to signal a demand for heat. Since the second contact set 111 of the second relay is closed at the instant of thermostat closure, the thermostat contact 29 and the second contact set 111 cooperate to momentarily disable the probe electrical signal by shorting the probe 25. Thereupon, the FET 65 is switched to an ungated state, thereby preventing the first gating capacitor 45 from maintaining a charge. As a result, the gating transistor 55 and therefore the power rectifier 46 are switched to nonconductive states to momentarily de-energize the first relay coil 39. Upon de-energization, the second contact set 109 of the first relay will close to energize the coil 95 of the second relay through the contact set 109 and the thermostat contacts 29 and a holding circuit for the coil 95 is provided by the closure of the first contact set 107 of the second relay. The simultaneous opening of the second contact set 111 of the second relay will re-enable the probe 25 to reestablish the electrical signal and ultimately switch the power rectifier 46 to a conducting state as described above. Thereupon, the first relay coil 39 is re-energized, its first contact set 105 closed and the main fuel valve coil 106 energized through the contact set 105, the contact set 107 and the thermostat contacts 29.

From the foregoing description of the schematic diagram of FIG. 2, it should be appreciated that the momentary shorting of the probe electrical signal in a standing pilot system electrically simulates the ignition of a flame in a pilot ignition system and similarly permits verification of the integrity of the main fuel valve circuit. Additionally, the intentional or inadvertent extinction of the pilot flame 23 and consequent loss of the electrical signal representative thereof will cause the first relay coil 39 to be de-energized and the main fuel valve 19 to close to a gas flow prohibiting position within a relatively short time which, in a preferred embodiment, is about 0.8 seconds. Since one of the purposes of the inventive apparatus is to force human intervention in the event of inadvertent loss of the pilot flame, it is preferable that no provision be made for pilot re-ignition except by the aforedescribed manual means.

The following component values have been found operable in a preferred embodiment. Resistance (R) is in ohms; capacitance (C) is in microfarads.

| | | | |
|---|---|---|---|
| R2 | 1K | R9 | 270 |
| R3 | 2.2 M | R11 | 4.7 M |
| R4, R5, R6 | 120K | R12 | 47 |
| R7, R8 | 22 M | R13 | 10K |
| C1 | 47 | C3 | 10 |
| C2 | 0.33 | C4 | 0.022 |
| SCR1 | C106 | D1, D2 | IN5059 |

-continued

| | |
|---|---|
| Q1 | MPU133 |
| Q2 | 5AT3821 |

While only a single preferred embodiment has been shown and described herein, it is not intended to be limited thereby but only by the scope of the appended claims.

I claim:

1. An apparatus for repetitively verifying the integrity of a main fuel valve control circuit in a standing pilot burner system comprising:

a probe circuit for providing an electrical signal representative of the presence of a standing pilot flame;

a first circuit including a controllably gated transistor for receiving said electrical signal and responsively energizing a gating network, thereby energizing a first relay prior to the occurrence of a heat demand signal;

a second circuit adapted to be connected to a thermostat contact, said contact providing a heat demand signal to said apparatus, said second circuit including a conductive path for disabling said probe circuit upon closure of said thermostat contact;

said first circuit responsively de-energizing said gating network and said first relay upon said disabling of said probe circuit;

said second circuit energizing a second relay in response to said first relay de-energization, thereby sequentially re-enabling said probe circuit and re-energizing said first relay to actuate a main fuel valve.

2. The invention set forth in claim 1 wherein said first circuit further includes a power rectifier network coupled to said gating network, said power rectifier network energizing said first relay upon energization of said gating network.

3. The invention set forth in claim 2 wherein said gated transistor is coupled to said probe circuit for receiving said electrical signal and responsively energizing said gating network.

4. The invention set forth in claim 3 wherein the loss of said pilot flame sequentially de-energizes said gating network, said power rectifier network and said first relay whereby said main fuel valve is rapidly de-energized to a gas flow prohibiting position.

5. The invention set forth in claim 4 wherein said main fuel valve is de-energized by a contact of said first relay, said contact being opened when said first relay is de-energized.

6. An apparatus for repetitively verifying the integrity of a main fuel valve relay in a fuel combustion system comprising:

a first circuit including a transistor network, a power rectifier network, a gating network connected intermediate said transistor and rectifier networks and a main fuel valve relay connected to said rectifier network for energizing said fuel valve relay upon reception at said transistor network of an electrical signal representative of the presence of a pilot flame;

a second relay coupled to said first circuit and including a contact set movable between a first, closed position and a second, open position, said contact set being adapted to be connected to a thermostat contact and cooperating in said first position with said thermostat contact for momentarily disabling said electrical signal to de-energize said fuel valve relay;

said contact set re-enabling said electrical signal when in said second position whereby said fuel valve relay is re-energized.

7. A method for controlling a main fuel valve in a standing pilot burner system comprising the steps of:

providing an electrical signal representative of the presence of a standing pilot flame wherein said electrical signal is generated by a flame probe circuit;

energizing a first relay in response to said electrical signal;

receiving a heat demand signal resulting from the closure of a thermostat contact;

disabling said probe circuit in response to said closure of said thermostat contact;

de-energizing said first relay in response to said disablement of said probe circuit;

energizing a second relay in response to said de-energizing of said first relay;

re-enabling said probe circuit in response to said energizing of said second relay, and;

re-energizing said first relay in response to said re-enabling of said probe circuit thereby actuating a main fuel valve.

8. The method set forth in claim 7 wherein said second relay includes a contact set movable between a first, closed position and a second, open position, said contact set being adapted to be connected to said thermostat contact, said probe circuit being disabled when said contact set is in said closed position.

9. A method for repetitively verifying the integrity of a main fuel valve circuit and including the steps of:

generating an electrical signal in the presence of a pilot flame, said signal being generated by a probe circuit;

receiving said electrical signal at a gated transistor of a first circuit, said first circuit further including a power rectifier network for controllably energizing a first relay and a gating network connected between said gated transistor and said rectifier network;

gating said power rectifier network to a conductive state, thereby energizing said first relay;

signalling a demand for heat by the closure of a thermostat contact;

disabling said probe circuit, said disabling being by a second relay having a normally closed contact set connected to said thermostat contact and conductive therewith when said contact set and said thermostat contact are closed;

disabling said power rectifier network for de-energizing said first relay, said disabling of said rectifier network being in response to said disabling of said probe circuit;

energizing said second relay in response to the de-energization of said first relay, said energizing of said second relay thereby re-enabling said probe circuit;

re-energizing said first relay to actuate a main fuel valve, said re-energization of said first relay being in response to said energizing of said second relay.

* * * * *